US009201394B2

(12) United States Patent
Hiraoka et al.

(10) Patent No.: US 9,201,394 B2
(45) Date of Patent: Dec. 1, 2015

(54) IMAGE FORMING APPARATUS AND AIR FLOW PATH THEREIN

(75) Inventors: Chikara Hiraoka, Osaka (JP); Tamotsu Ikeda, Osaka (JP); Yuusuke Furuichi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 13/170,790

(22) Filed: Jun. 28, 2011

(65) Prior Publication Data

US 2012/0002997 A1 Jan. 5, 2012

(30) Foreign Application Priority Data

Jul. 5, 2010 (JP) ..... 2010-152904

(51) Int. Cl.
*G03G 21/20* (2006.01)
*G03G 15/20* (2006.01)

(52) U.S. Cl.
CPC ..... *G03G 21/206* (2013.01); *G03G 15/2064* (2013.01)

(58) Field of Classification Search
USPC ..... 430/124.1; 399/122
See application file for complete search history.

(56) References Cited

U.S. PATENT DOCUMENTS 2,166,349 A * 7/1939 Fredd ..... 242/592
5,471,280 A * 11/1995 Taguchi ..... 399/330
5,732,309 A * 3/1998 Okuno et al. ..... 399/68
6,021,290 A * 2/2000 Hamada et al. ..... 399/92
6,240,265 B1 * 5/2001 Noh ..... 399/92
6,393,246 B2 * 5/2002 Tsujihara ..... 399/322
6,754,458 B2 * 6/2004 Makihira ..... 399/92
7,187,895 B2 * 3/2007 Nakano et al. ..... 399/322
7,386,247 B2 * 6/2008 Doi ..... 399/93
7,611,106 B2 11/2009 Kondo et al.
7,751,749 B2 7/2010 Idehara et al.
7,835,661 B2 11/2010 Idehara et al.
7,844,196 B2 11/2010 Kita et al.
7,852,638 B2 12/2010 Kondo et al.
7,854,418 B2 12/2010 Idehara et al.
7,925,199 B2 4/2011 Tada et al.
7,937,015 B2 5/2011 Furuichi et al.
7,941,069 B2 5/2011 Idehara et al.

(Continued)

FOREIGN PATENT DOCUMENTS

CN 1837976 A 9/2006
CN 1900832 A 1/2007

(Continued)

OTHER PUBLICATIONS

Chinese Office Action issued Nov. 19, 2012 in Patent Application No. 201110184975.0.

(Continued)

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

An image forming apparatus including an intake opening from which an outside air is drawn, a fixing device disposed above the intake opening to heat a recording medium to fix an image onto the recording medium, and a flow path for the air drawn from the intake opening to direct the air onto devices or components provided near the fixing device inside the image forming apparatus by negative pressure generated by an upward current of hot air generated from the fixing device.

17 Claims, 6 Drawing Sheets

(56) References Cited

U.S. PATENT DOCUMENTS

| | | | | |
|---|---|---|---|---|
| 2003/0147666 | A1 | 8/2003 | Miyakoshi et al. | |
| 2004/0052548 | A1* | 3/2004 | Shimizu et al. | 399/122 |
| 2005/0074251 | A1* | 4/2005 | Katoh et al. | 399/68 |
| 2006/0018679 | A1 | 1/2006 | Ishino et al. | |
| 2007/0122177 | A1 | 5/2007 | Doi | |
| 2008/0279585 | A1 | 11/2008 | Furuichi et al. | |
| 2008/0292356 | A1 | 11/2008 | Furuichi et al. | |
| 2008/0317532 | A1* | 12/2008 | Ehara et al. | 399/400 |
| 2009/0074446 | A1 | 3/2009 | Idehara et al. | |
| 2009/0103959 | A1 | 4/2009 | Koyama et al. | |
| 2009/0110449 | A1 | 4/2009 | Saito et al. | |
| 2009/0129836 | A1 | 5/2009 | Sakaya et al. | |
| 2009/0285588 | A1 | 11/2009 | Furuichi et al. | |
| 2010/0034548 | A1* | 2/2010 | Naitoh et al. | 399/69 |
| 2010/0239297 | A1 | 9/2010 | Sakaya et al. | |
| 2010/0260524 | A1 | 10/2010 | Hiraoka et al. | |
| 2010/0278574 | A1* | 11/2010 | Miyazawa | 399/400 |
| 2011/0058847 | A1 | 3/2011 | Furuichi et al. | |
| 2011/0062835 | A1 | 3/2011 | Idehara et al. | |
| 2011/0064456 | A1 | 3/2011 | Tada et al. | |

FOREIGN PATENT DOCUMENTS

| | | | | | |
|---|---|---|---|---|---|
| CN | 101644909 | A | | 2/2010 | |
| JP | 54-003942 | A | | 1/1979 | |
| JP | 03-018867 | A | | 1/1991 | |
| JP | 05-053462 | A | | 3/1993 | |
| JP | 05-173394 | A | | 7/1993 | |
| JP | 2825857 | | | 9/1998 | |
| JP | 2001-201978 | A | | 7/2001 | |
| JP | 2003-295655 | A | | 10/2003 | |
| JP | 2003295655 | A | * | 10/2003 | G03G 15/20 |
| JP | 2004-170832 | A | | 6/2004 | |
| JP | 2004-271563 | | | 9/2004 | |
| JP | 2006-30790 | | | 2/2006 | |
| JP | 2008-152126 | A | | 7/2008 | |

OTHER PUBLICATIONS

Office Action issued Dec. 20, 2013 in Japanese Patent Application No. 2010-152904.

Chinese Office Action issued Apr. 17, 2014, in China Patent Application No. 201110184975.0.

Office Action issued on Apr. 24, 2013 in the corresponding Chinese Patent Application No. 201110184975.0.

* cited by examiner

IMAGE FORMING APPARATUS AND AIR FLOW PATH THEREIN

CROSS-REFERENCE TO RELATED APPLICATIONS

The present patent application is based on and claims priority pursuant to 35 U.S.C. §119 from Japanese Patent Application No. 2010-152904, filed on Jul. 5, 2010, in the Japan Patent Office, which is incorporated herein by reference in its entirety.

BACKGROUND OF THE INVENTION

1. Field of the Invention

Exemplary aspects of the present invention generally relate to an image forming apparatus including a fixing device that fixes an image onto a recording medium.

2. Description of the Background

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; a cleaning device removes residual toner from the surface of the photoconductor, and a fixing device applies heat and pressure to the sheet bearing the toner image to fix the toner image onto the sheet. The sheet bearing the fixed toner image is then discharged from the image forming apparatus.

In the fixing device, a fixing member heated by a heat source and an opposing member (or a pressing member) provided opposite the fixing member contact each other to form a fixing nip therebetween. Heat and pressure are applied to the sheet while the sheet is passing through the fixing nip so as to fix the toner image onto the sheet.

The heat generated by the fixing device can cause internal problems for the image forming apparatus. For this reason, an exhaust fan or a cooling fan is often provided near the fixing device so as to forcibly exhaust the heat generated from the fixing device to the outside, thereby preventing the heat from the fixing device from adversely affecting operation or performance of components or devices of the image forming apparatus provided near the fixing device.

However, provision of the exhaust fan increases both size and production costs of the image forming apparatus, and moreover the exhaust fan can be noisy.

Accordingly, an image forming apparatus in which the heat generated by the fixing device is released to the outside without using an exhaust fan has been proposed. Specifically, the fixing device is disposed in an upper separate portion of the image forming apparatus, and the heat generated from the fixing device is exhausted from a first air vent to the outside. At the same time, the tendency of heat to rise is utilized to draw outside air from a second air vent to cool the fixing device. However, such a configuration increases the height of the image forming apparatus, and is not suitable for a tandem-type compact image forming apparatus.

SUMMARY

In view of the foregoing, illustrative embodiments of the present invention provide a novel image forming apparatus including a fixing device. A temperature increase in the image forming apparatus due to heat generated from the fixing device can be prevented without using an exhaust fan, thereby making the image forming apparatus more compact.

In one illustrative embodiment, an image forming apparatus includes an intake opening from which an outside air is drawn, a fixing device disposed above the intake opening to heat a recording medium to fix an image onto the recording medium, and a flow path for the air drawn from the intake opening to direct the air onto devices or components provided near the fixing device inside the image forming apparatus by negative pressure generated by an upward current of hot air generated from the fixing device.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
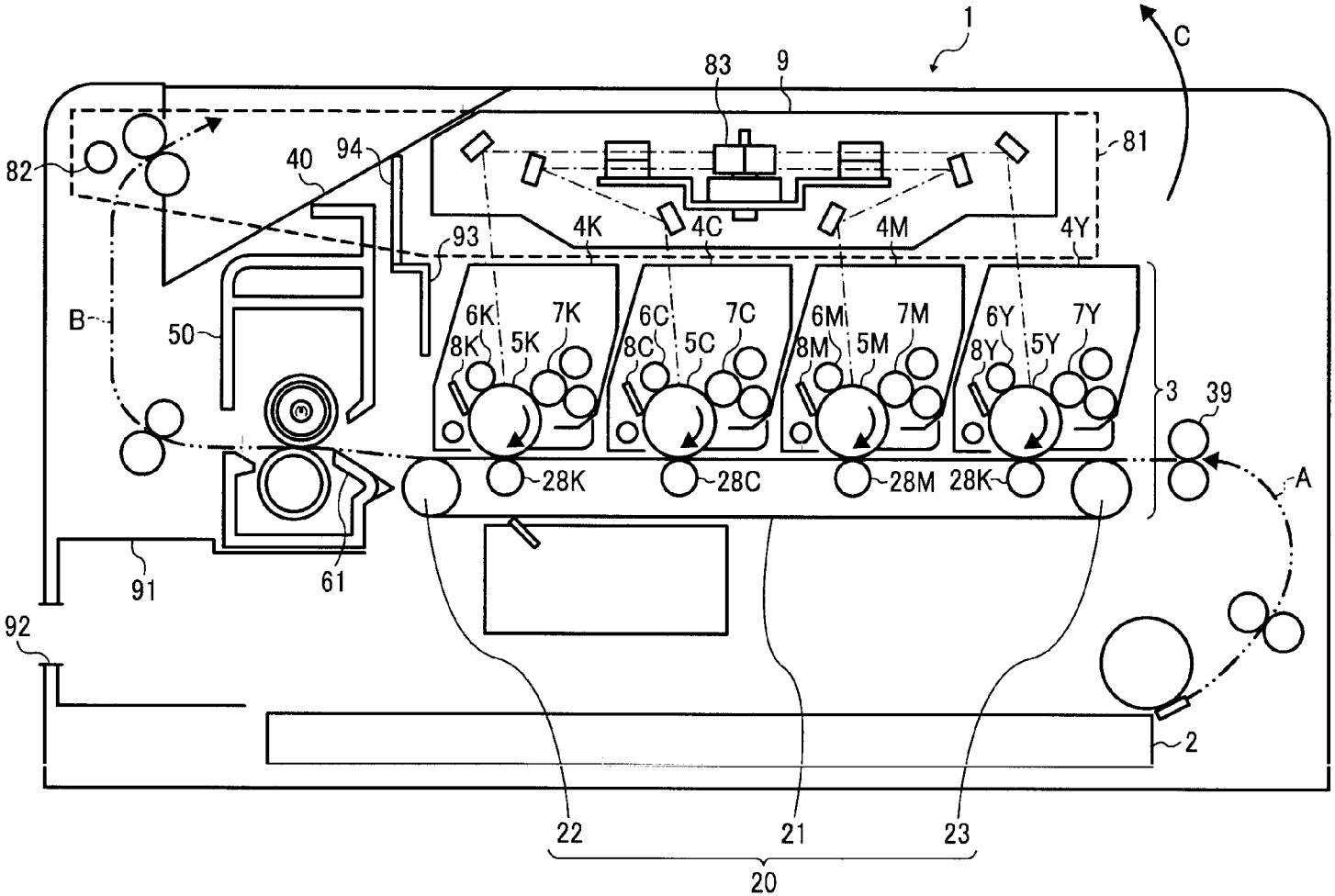
FIG. 1 is a vertical cross-sectional view illustrating an example of a configuration of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of an image forming apparatus 1 according to illustrative embodiments is described in detail below. FIG. 1 is a vertical cross-sectional view illustrating an example of a configuration of an image forming apparatus 1 according to a first illustrative embodiment.

The image forming apparatus 1 includes a sheet feeder 2 that stores recording media such as sheets of paper in a lower portion thereof and an image forming part 3 provided above the sheet feeder 2. The image forming apparatus 1 further includes a sheet discharge tray 40 on an upper surface thereof. The sheets stored in the sheet feeder 2 are fed one by one to the image forming part 3 through a conveyance path indicated by a broken-line arrow A in FIG. 1, and an image formed by the image forming part 3 is transferred onto the sheet. The sheet bearing the transferred image thereon is then conveyed to a fixing device 50 to fix the image onto the sheet. Thereafter, the sheet is conveyed through a conveyance path indicated by a broken-line arrow B in FIG. 1 to be discharged to the sheet discharge tray 40.

The image forming part 3 includes a transfer belt device 20 extending in a horizontal direction and four image forming units 4Y, 4M, 4C, and 4K (hereinafter collectively referred to as image forming units 4) arranged side by side in the horizontal direction above the transfer belt device 20. Specifically, the image forming units 4Y, 4M, 4C, and 4K are provided in that order from upstream to downstream in a direction of conveyance of the sheet. Toner images of a specific color, that is, yellow (Y), magenta (M), cyan (C), or black (K), respectively formed by the image forming units 4, are sequentially transferred onto the sheet while the sheet is conveyed in the horizontal direction by the transfer belt device 20.

It is to be noted that, each of the four image forming units 4 has the same basic configuration, differing only in the color of toner used.

The image forming units 4 include photoconductors 5Y, 5M, 5C, and 5K (hereinafter collectively referred to as photoconductors 5) each serving as an image carrier. The photoconductors 5 are rotatively driven by a drive unit, not shown, in a clockwise direction in FIG. 1. Charging rollers 6Y, 6M, 6C, and 6K (hereinafter collectively referred to as charging rollers 6) that charge surfaces of the photoconductors 5, developing rollers 7Y, 7M, 7C, and 7K (hereinafter collectively referred to as developing rollers 7) that supply toner to the surfaces of the photoconductors 5 to form toner images, and cleaning devices 8Y, 8M, 8C, and 8K that clean the surfaces of the photoconductors 5 are provided around the photoconductors 5. It is to be noted that the image forming apparatus 1 employs developing devices respectively including the developing rollers 7 in which non-magnetic single-component toner is used.

An optical unit 9 serving as irradiating means for directing light beams onto portions of the charged surfaces of the photoconductors 5 between the charging rollers 6 and the developing rollers 7, is provided above the image forming units 4. The optical unit 9 is supported on an upper cover arm 81. The upper cover arm 81 is rotatable around a fulcrum 82 in a direction indicated by an arrow C in FIG. 1, to be opened from a main body of the image forming apparatus 1 together with the optical unit 9 and the sheet discharge tray 40.

The transfer belt device 20 includes a drive roller 22, a driven roller 23, and an endless transfer belt 21 wound around the drive roller 22 and the driven roller 23. Transfer rollers 28Y, 28M, 28C, and 28K (hereinafter collectively referred to as transfer rollers 28), to each of which a transfer bias is applied, are provided opposite the photoconductors 5, respectively, with an upper part of a loop of the transfer belt 21 interposed therebetween. Specifically, the transfer rollers 28 are provided in contact with the transfer belt 21 inside the loop of the transfer belt 21.

During full-color image formation, the transfer belt device 20 is held such that the transfer belt 21 contacts all four photoconductors 5. By contrast, during monochrome image formation, the transfer belt device 20 is held such that the transfer belt 21 contacts only the photoconductor 5K.

The fixing device 50 includes an entrance guide 61 that guides the sheet conveyed from the transfer belt device 20 to a fixing nip, and is held by a stay 91 having an intake opening 92 from which air is drawn into the image forming apparatus 1 from the outside. The intake opening 92 is provided below the fixing device 50. An L-shaped fixing stay 93 passing through each of right and left lateral plates of a frame of the image forming apparatus 1 is provided between the fixing device 50 and the image forming unit 4K, thereby providing secure strength to the frame of the image forming apparatus 1. A shield 94 formed of a heat-resistant material such as heat-resistant resin is provided above the fixing stay 93 to prevent direct transmission of heat from the fixing device 50 to the optical unit 9.

Operation of the image forming apparatus 1 is described in detail below, again with reference to FIG. 1.

First, in the image forming unit 4Y, the surface of the photoconductor 5Y is evenly charged to a predetermined electric potential by the charging roller 6Y. Simultaneously, in the optical unit 9, a laser diode, not shown, is driven to direct laser light onto a polygon mirror 83 based on image data sent from a host device such as a personal computer. Light reflected from the polygon mirror 83 is directed onto the surface of the photoconductor 5Y via a cylinder lens and so forth to form an electrostatic latent image of the color yellow on the surface of the photoconductor 5Y. Then, yellow toner is supplied from the developing roller 7Y to the electrostatic latent image thus formed to form a yellow toner image on the surface of the photoconductor 5Y.

Meanwhile, a sheet is fed from the sheet feeder 2. Conveyance of the sheet thus fed is temporarily stopped when the sheet contacts a pair of registration rollers 39 provided along the conveyance path indicated by the broken-line arrow A in FIG. 1. During full-color image formation, the transfer belt 21 is lifted to contact all four photoconductors 5 in the image forming units 4. The pair of registration rollers 39 is rotated such that the sheet is conveyed to the transfer belt 21 in synchronization with the toner image formed on the surface of the photoconductor 5Y. Then, the sheet is conveyed by rotation of the transfer belt 21 to a transfer position opposite the photoconductor 5Y. At the transfer position, the yellow toner image is transferred onto the sheet by the transfer roller 28Y provided in contact with a back surface of the transfer belt 21 opposite the photoconductor 5Y.

The above-described processes performed in the image forming unit 4Y are also performed in the rest of the image forming units 4M, 4C, and 4K, so that toner images of respective colors are sequentially transferred onto the sheet conveyed by the transfer belt 21 at respective transfer positions and are superimposed one atop the other to form a full-color tone/image on the sheet.

By contrast, during monochrome image formation, the transfer belt 21 is lowered so as to contact only the photoconductor 5K in the image forming unit 4K. Accordingly, a black toner image formed on the surface of the photoconductor 5K is transferred onto the sheet conveyed to the transfer belt 21 in synchronization with the black toner image.

The sheet bearing the toner image thereon is then separated from the transfer belt 21 to be further conveyed to the fixing device 50. In the fixing device 50, the toner image is fixed onto the sheet. Thereafter, the sheet having the fixed toner image thereon is discharged to the sheet discharge tray 40 provided on the upper surface of the image forming apparatus 1.

Figure 2:
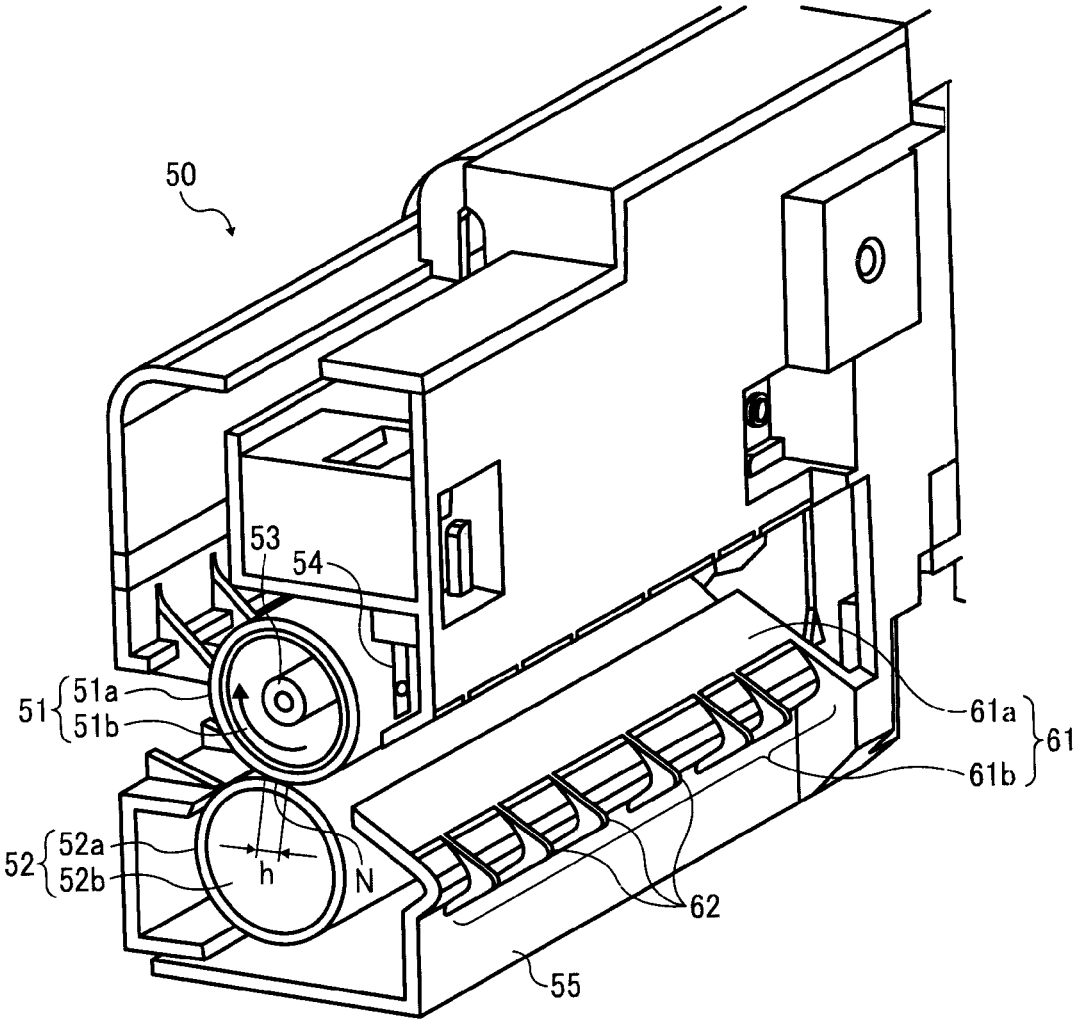
FIG. 2 is a perspective view illustrating an example of a configuration of a fixing device according to the first illustrative embodiment.

A description is now given of a configuration and operation of the fixing device 50 with reference to FIG. 2. FIG. 2 is a perspective view illustrating an example of a configuration of the fixing device 50 according to the first illustrative embodiment.

The fixing device 50 includes a fixing roller 51 serving as a fixing member, a pressing roller 52 serving as an opposing member provided opposite the fixing roller 51, and the entrance guide 61. The fixing roller 51 is an elastic roller having an outer diameter of ϕ25, and is constructed of a hollow cylindrical metal core 51*b* having a thickness of 0.5 mm covered with an elastic layer 51*a* of silicone rubber having a thickness of 1.5 mm and a JIS hardness of 21 degrees. The surface of the pressing roller 52 is coated with PFA (tetrafluoroethylene-perfluoroalkyl vinyl ether copolymer) having a thickness of 30 μm in order to achieve good releasability from the toner. As a result, the surface of the fixing roller 51 has an apparent hardness of 76 degrees as measured by an ASKER-C hardness tester. A heater 53 serving as a heat source is provided within the fixing roller 51. Heat generation of the heater 53 is controlled based on a temperature detected by a thermistor 54 serving as a temperature detector provided in contact with the surface of the fixing roller 51. In the first illustrative embodiment, the heater 53 is controlled such that a temperature of the surface of the fixing roller 51 is maintained between 155° C. and 165° C. It is to be noted that the fixing roller 51 is rotated by a gear, not shown, in a clockwise direction in FIG. 2.

The pressing roller 52 is an elastic roller having an outer diameter of ϕ25. Specifically, the pressing roller 52 is constructed of a solid aluminum core 52*b* covered with an elastic layer 52*a* of silicone rubber having a thickness of 1.5 mm and a JIS hardness of 23 degrees. The surface of the pressing roller 52 is coated with PFA (tetrafluoroethylene-perfluoroalkyl vinyl ether copolymer) having a thickness of 30 μm in order to achieve good releasability from the toner. The pressing roller 52 is pressed against the fixing roller 51 at a load of 150 N by a spring, not shown, so that a fixing nip N is formed between the fixing roller 51 and the pressing roller 52. In the first illustrative embodiment, a width h of the fixing nip N is 4 mm.

The entrance guide 61 is constructed of a ribbed portion 61*b* having multiple ribs (or convexities) 62 provided on a downstream part thereof in a direction of conveyance of the sheet and a contiguous planar portion 61*a* without ribs provided upstream from the ribbed portion 61*b* in the direction of conveyance of the sheet. The sheet conveyed from the transfer belt device 20 contacts the ribbed portion 61*b* and the planar portion 61*a*, in that order, while being guided inside the fixing device 50 via the entrance guide 61. Unevenness in a leading edge of the sheet generated at the ribbed portion 61*b* can be flattened by the planar portion 61*a*. As a result, the sheet can be reliably guided to the fixing nip N and wrinkling of the sheet can be prevented. In addition, a surface of the entrance guide 61 is coated with a fluorinated resin. Accordingly, resistance of conveyance of the sheet can be reduced, and toner adhering to the entrance guide 61 due to scattering of unfixed toner can be easily wiped cut. Although integrally formed with an exterior part 55 of the fixing device 50 in the first illustrative embodiment shown in FIG. 2, alternatively, the entrance guide 61 may be formed separately from the exterior part 55.

It is to be noted that the configuration of the fixing device 50 is not limited to the above-described example. For example, at least one of the fixing member and the opposing member may be formed of a seamless belt, and the seamless belt may be pressed against the other one of the fixing member and the opposing member by a roller, a pad, or the like. Further alternatively, the fixing member and the opposing member may merely contact each other but without being pressed against each other.

Figure 3:
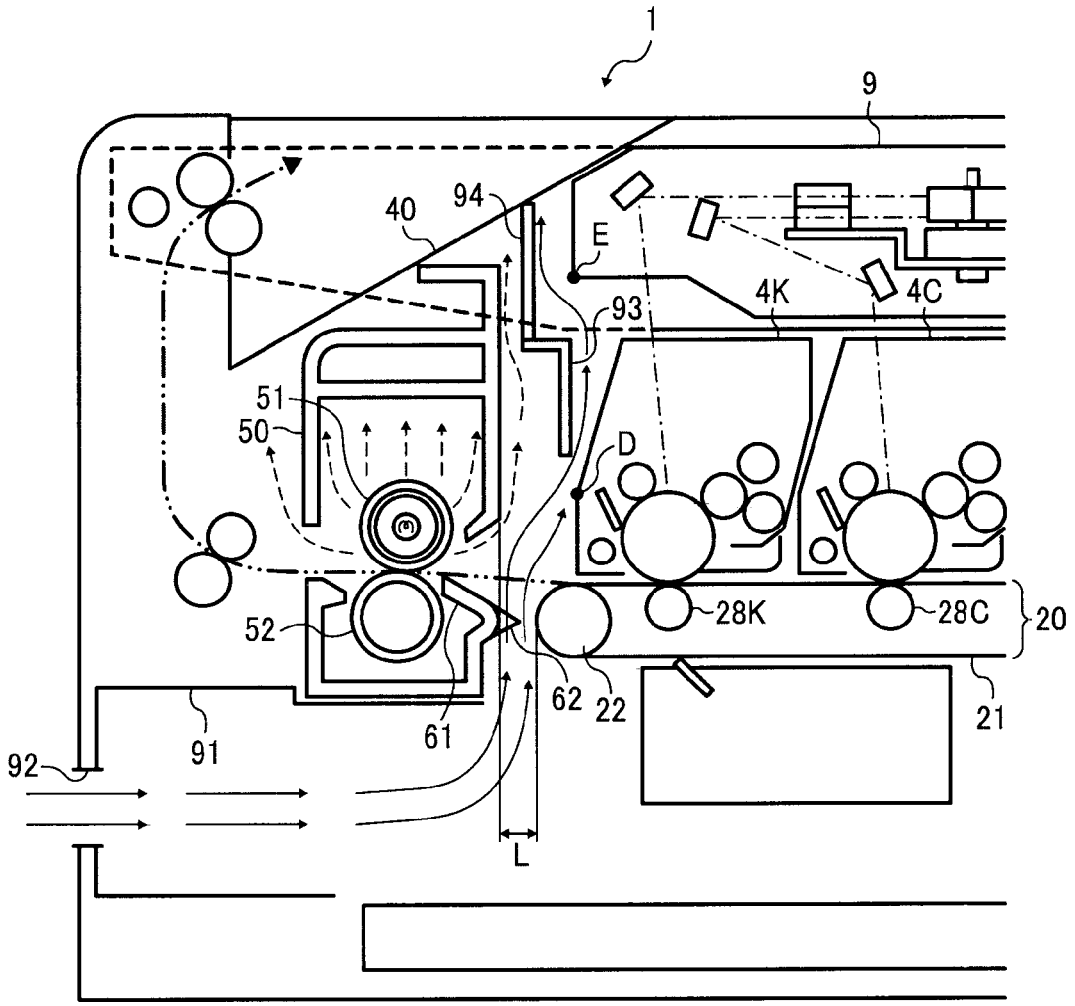
FIG. 3 is a vertical cross-sectional view illustrating flows of air generated within the image forming apparatus according to the first illustrative embodiment.

A description is now given of a flow of air generated within the image forming apparatus 1, with reference to FIG. 3. It is to be noted that, in FIG. 3, broken-line arrows indicate thermal air currents generated from the fixing roller 51 and solid arrows indicate currents of air drawn from the intake opening 92. Hot air generated from the fixing roller 51 flows upward above the fixing device 50, thereby generating negative pressure around the fixing device 50 due to the upward current of hot air. As a result, outside air is drawn from the intake opening 92 provided in a lower part of the image forming apparatus 1. The air drawn from the intake opening 92 passes between each of the multiple ribs 62 provided to the entrance guide 61 to be led to the image forming unit 4K and the optical unit 9. Thus, the cooler air drawn from the outside can prevent a temperature increase in the image forming unit 4K and the optical unit 9. In addition, the multiple ribs 62 provided to the entrance guide 61 form a flow path for the air. Accordingly, the air drawn from the intake opening 92 can be guided to the image forming unit 4K and the optical unit 9 without being blocked by the entrance guide 61.

The air drawn from the intake opening 92 and the hot air generated from the fixing device 50 are guided separately from each other by the fixing stay 93 and the shield 94, respectively. Specifically, the air drawn from the intake opening 92 is separated from the hot air generated from the fixing device 50 by the fixing stay 93 and the shield 94, to be guided to the image forming unit 4K and the optical unit 9. Meanwhile, the hot air generated from the fixing device 50 is prevented from flowing toward the image forming unit 4K and the optical unit 9 by the fixing stay 93 and the shield 94. Thus, each of the fixing stay 93 and the shield 94 functions as a partition that guides the air drawn from the intake opening 92 and the hot air generated from the fixing device 50 separately from each other, thereby more effectively preventing a temperature increase in the image forming unit 4K and the optical unit 9.

Taking the known heat-resistance of toner into consideration, it is necessary to control the image forming unit 4K to have a temperature of no more than 45° C. Accordingly, the inventors of the present invention conducted an experiment for finding conditions at which a temperature of each of the image forming unit 4K and the optical unit 9 is kept to 45° C. or lower. Specifically, a temperature at each of a point D in the image forming unit 4K and a point E in the optical unit 9, respectively, shown in FIG. 3, was measured under various conditions. Table 1 below shows results obtained from the experiment.

TABLE 1

| | Case 1 | Case 2 | Case 3 |
|---|---|---|---|
| Shield | Not provided | Not provided | Provided |
| Gap L | 2 mm | 5 mm | 10 mm |
| Temperature at Point E | 72.6° C. | 66° C. | 34.5° C. |
| Temperature at Point D | 67.8° C. | 48.9° C. | 42.7° C. |

In Case 1 shown in Table 1, the shield 94 was not provided, and a gap L of 2 mm was formed between the transfer belt device 20 and the fixing device 50 as the flow path for the air drawn from the intake opening 92. In Case 2, the shield 94 was not provided, and a gap L of 5 mm was formed between the transfer belt device 20 and the fixing device 50. In Case 3, the shield 94 was provided, and a gap L of 10 mm was formed between the transfer belt device 20 and the fixing device 50. In each of Cases 1 to 3, a temperature on the surface of the fixing roller 51 was kept at 165° C., that is, the temperature of the fixing roller 51 during standby, and a temperature outside the fixing device 50 was kept at 30° C.

Based on the above-described results, it was found that the temperature of each of the image forming unit 4K and the optical unit 9 can be kept at 45° C. or lower during standby of the fixing device 50 in Case 3, in which the gap L of 10 mm was formed between the transfer belt device 20 and the fixing device 50 and the shield 94 was provided between the fixing device 50 and the optical unit 9.

Therefore, in order to keep the temperature of each of the image forming unit 4K and the optical unit 9 at 45° C. or lower under the condition in which the temperature of the fixing roller 51 is set to 165° C. or lower, it is necessary to provide at least the gap L of 10 mm or larger between the fixing device 50 and the transfer belt device 20 as the flow path for the air drawn from the intake opening 92 and the shield 94 between the fixing device 50 and the optical unit 9.

However, during a continuous print operation, in which images are continuously formed on consecutive multiple sheets, the gap L between the transfer belt device 20 and the fixing device 50 is frequently blocked by the sheets continuously conveyed to the fixing device 50. Consequently, the air drawn from the intake opening 92 cannot be sufficiently guided to the image forming unit 4K and the optical unit 9. Therefore, during continuous printing, heating of the fixing device 50 is automatically stopped to move the fixing device 50 to a standby mode each time a predetermined period of time elapses or images are formed on a predetermined number of sheets. Accordingly, the image forming apparatus 1 is controlled not to start image formation until the temperature of the fixing device 50 is decreased to a predetermined value. As a result, a temperature increase in each of the image forming unit 4K and the optical unit 9 can be prevented.

Figure 4:
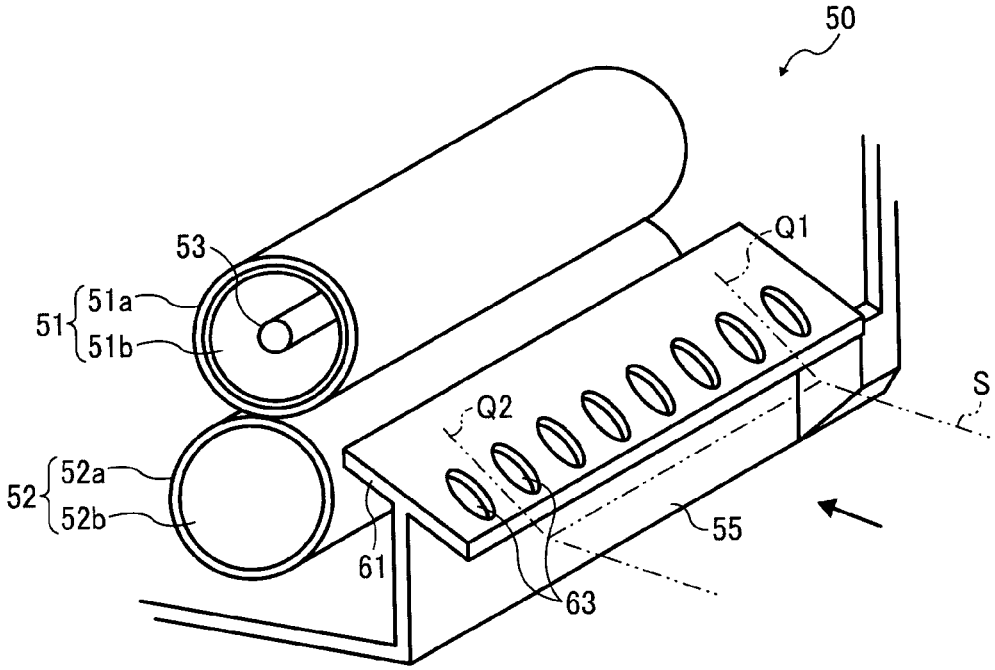
FIG. 4 is a perspective view illustrating a configuration of an entrance guide provided to the fixing device according to a first variation of the first illustrative embodiment.
Figure 5:
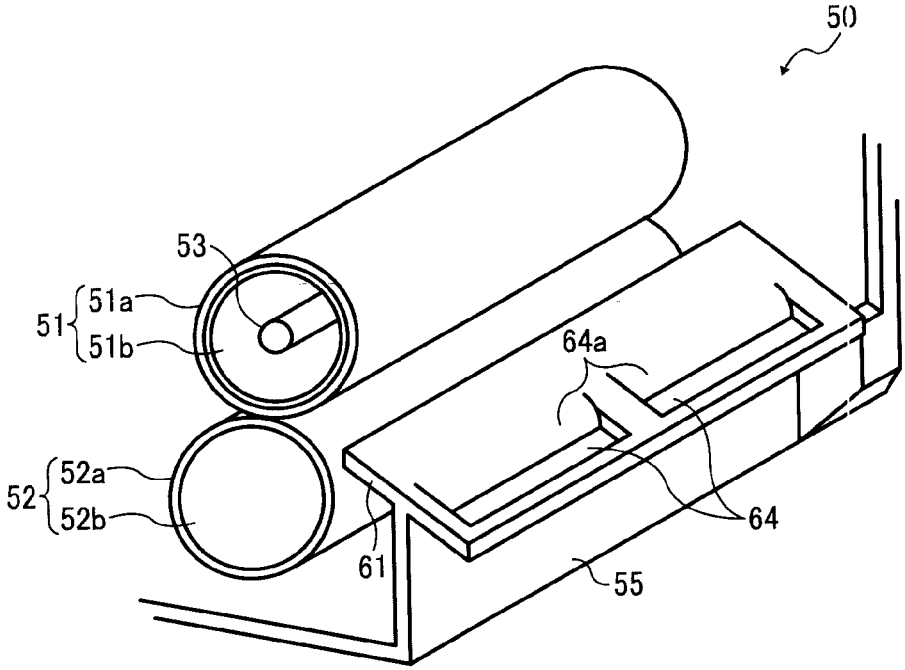
FIG. 5 is a perspective view illustrating a configuration of an entrance guide provided to the fixing device according to a second variation of the first illustrative embodiment.

A description is now given of a configuration of the entrance guide 61 according to variations of the first illustrative embodiment, with reference to FIGS. 4 and 5. FIG. 4 is a perspective view illustrating a configuration of the entrance guide 61 according to a first variation of the first illustrative embodiment. FIG. 5 is a perspective view illustrating a configuration of the entrance guide 61 according to a second variation of the first illustrative embodiment.

The entrance guide 61 according to the first variation of the first illustrative embodiment has multiple round holes 63 in the entrance guide 61 on an upstream part thereof in the direction of conveyance of the sheet. Accordingly, the air drawn from the intake opening 92 passes through the multiple holes 63 to flow to the image forming unit 4K and the optical unit 9.

The entrance guide 61 according to the second variation of the first illustrative embodiment has two slots 64 in the entrance guide 61 on the upstream part thereof in the direction of conveyance of the sheet. Accordingly, the air drawn from the intake opening 92 passes through the slots 64 to flow to the image forming unit 4K and the optical unit 9.

As described above, the multiple round holes 63 or the slots 64 provided to the entrance guide 61 form the flow path for the air. Accordingly, similar to the first illustrative embodiment in which the multiple ribs 62 are provided to the entrance guide 61, the air drawn from the intake opening 92 can be guided to the image forming unit 4K and the optical unit 9 without being blocked by the entrance guide 61. It is to be noted that the shapes of the openings in the entrance guide 61 are not limited to the multiple round holes 63 and the slots 64 described above, and may be any shape capable of forming the incoming air into a suitable flow path.

Thus, the cooler air drawn from the outside can flow to the image forming unit 4K and the optical unit 9 through the entrance guide 61 illustrated in FIG. 4 or 5, thereby preventing a temperature increase in the image forming unit 4K and the optical unit 9. However, preferably, a leading edge or front corners of the sheet do not get stuck in the multiple round holes 63 or the slots 64. Therefore, in the first variation of the first illustrative embodiment, the multiple holes 63 are provided in the entrance guide 61 other than portions indicated by broken lines Q1 and Q2 in FIG. 4 where the front corners of a sheet S pass. Accordingly, the front corners of the sheet are prevented from getting stuck with the multiple holes 63. In the second variation of the first illustrative embodiment, portions 64*a* of each of the slots 64, with where the leading edge of the sheet contacts, are curved in order to prevent the leading edge of the sheet from getting stuck in the slots 64.

Figure 6:
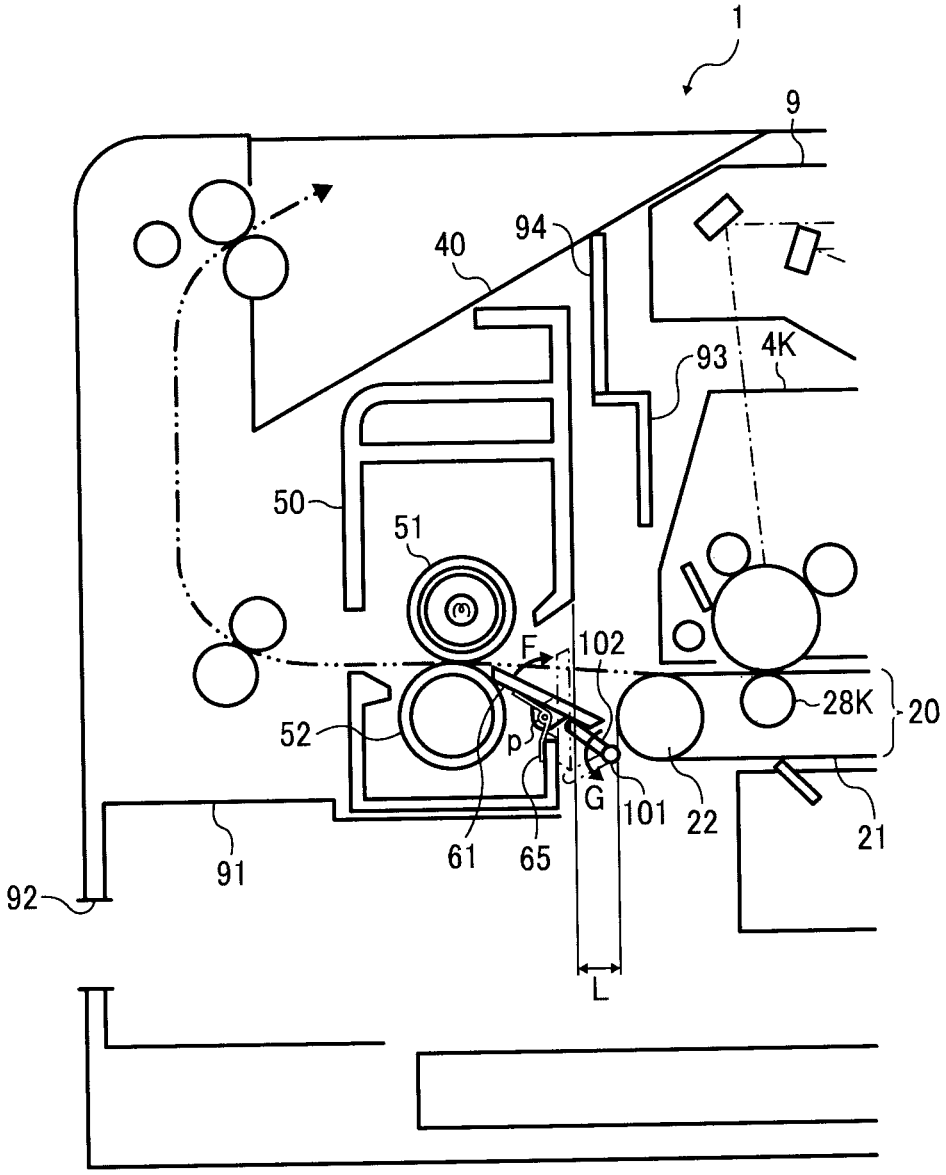
FIG. 6 is a vertical cross-sectional view illustrating an example of a configuration of a fixing device according to a second illustrative embodiment.

A description is now given of a second illustrative embodiment of the present invention. FIG. 6 is a vertical cross-sectional view illustrating a configuration of the fixing device 50 according to the second illustrative embodiment.

In the second illustrative embodiment, the entrance guide 61 is rotatable around a fulcrum p. The fulcrum p is provided with a spring 65 serving as a biasing member so that a force that rotates the entrance guide 61 in a direction indicated by an arrow F in FIG. 6 is applied to the entrance guide 61 from the spring 65. The image forming apparatus 1 further includes a shaft 101 provided with a lever 102. The lever 102 is rotatable using the shaft 101 as a rotary shaft.

When located at a position indicated by solid lines in FIG. 6, the lever 102 contacts a lower surface of the entrance guide 61. In such a state, the lever 102 supports the entrance guide 61 such that the entrance guide 61 is positioned where it acts against a biasing force from the spring 65 at the position indicated by solid lines. On the other hand, the entrance guide 61 is rotated in a direction indicated by the arrow F in FIG. 6 by the biasing force from the spring 65 to a position indicated by broken lines as the lever 102 is rotated from the position indicated by the solid lines to a direction indicated by an arrow G.

Similar to the first illustrative embodiment, the intake opening 92 is provided in the lower part of the image forming apparatus 1 so that the outside air is drawn into the image forming apparatus 1 from the intake opening 92 by the negative pressure generated by the upward currents of the hot air generated from the fixing device 50.

During image formation, the entrance guide 61 is supported at the position indicated by the solid lines in FIG. 6 to guide the sheet conveyed from the transfer belt device 20 to the fixing device 50. By contrast, during standby, the entrance guide 61 is located at the position indicated by the broken lines in FIG. 6 so that the flow path for the air drawn from the intake opening 92 is formed between the transfer belt device 20 and the fixing device 50. Thus, in the second illustrative embodiment, the entrance guide 61 is rotatable such that the position of the entrance guide 61 can be switched between a guide position to guide the sheet to the fixing device 50, that is, the position indicated by the solid lines in FIG. 6, and a path formation position to form the flow path for the air drawn from the intake opening 92, that is, the position indicated by the broken lines in FIG. 6. Accordingly, during standby, the entrance guide 61 is located at the path formation position to direct the air drawn from the intake opening 92 to the image forming unit 4K and the optical unit 9 through the gap L formed between the transfer belt device 20 and the fixing device 50. As a result, a temperature increase in the image forming unit 4K and the optical unit 9 can be prevented.

Similar to the first illustrative embodiment, the fixing stay 93 and the shield 94 are provided in the second illustrative embodiment. Thus, the air drawn from the intake opening 92 and the hot air generated from the fixing device 50 are guided separately from each other, thereby more effectively preventing a temperature increase in the image forming unit 4K and the optical unit 9.

Figure 7:
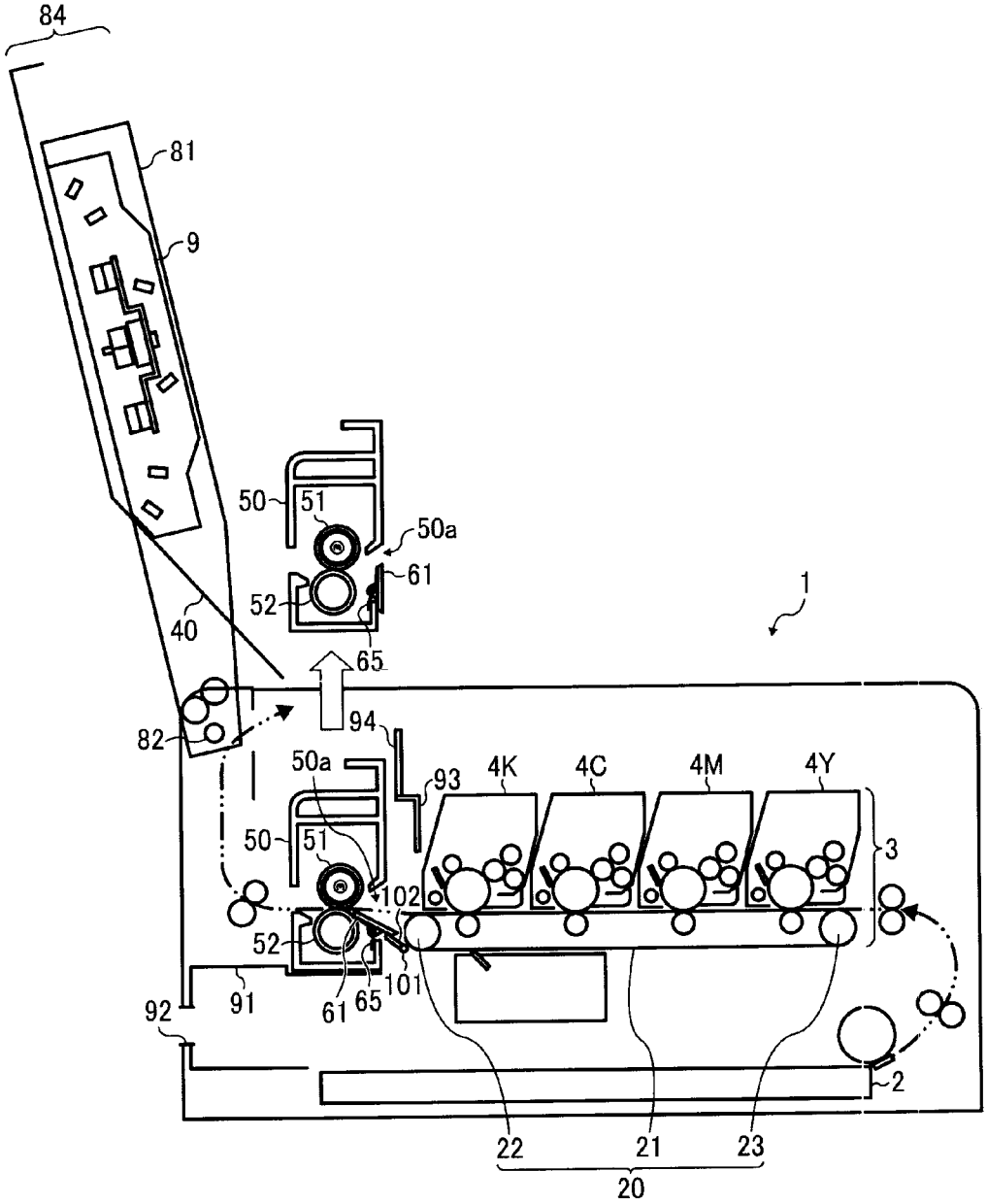
FIG. 7 is a vertical cross-sectional view illustrating installation and removal of the fixing device in and from the image forming apparatus according to the second illustrative embodiment.

FIG. 7 is a vertical cross-sectional view illustrating installation and removal of the fixing device 50 in and from the image forming apparatus 1 according to the second illustrative embodiment. When an upper cover 84 is rotated upward around the fulcrum 82 as illustrated in FIG. 7, the upper cover arm 31, the optical unit 9, the sheet discharge tray 40, and so forth are integrally moved together with the upper cover 84. Accordingly, the top of the image forming apparatus 1 is uncovered by rotating the upper cover 84 as described above, and the fixing device 50 is lifted from the uncovered top of the image forming apparatus 1 to be removed from the image forming apparatus 1. Thus, the fixing device 50 is installed in the image forming apparatus 1. As a result, a sheet stuck inside the image forming apparatus 1 can be easily removed by rotating the upper cover 84 upward as described above to uncover the top of the image forming apparatus 1 and removing the fixing device 50 from inside of the image forming apparatus 1.

While the fixing device 50 is installed in the image forming apparatus 1 during image formation, the entrance guide 61 is supported by the lever 102 as described above. In such a state, an opening 50*a* through which the sheet is conveyed into the fixing device 50 is maintained. Meanwhile, when the fixing device 50 is removed from the image forming apparatus 1, the entrance guide 61 is separated from the lever 102. Accordingly, the entrance guide 61 is biased by the spring 65 so that the opening 50*a* of the fixing device 50 is covered by the entrance guide 61. Thus, as a safety measure, the opening 50*a* of the fixing device 50 is automatically covered by the entrance guide 61 upon removal of the fixing device 50 from the image forming apparatus 1, thereby preventing a user from inadvertently touching the hot fixing roller 51 through the opening 50*a*.

In the image forming apparatus 1 according to the foregoing illustrative embodiments, the air can be drawn into the image forming apparatus 1 from the intake opening 92 by the negative pressure generated by the upward currents of the hot air generated from the fixing device 50. Accordingly, a temperature increase in components provided near the fixing device 50, such as the image forming unit 4K and the optical unit 9, can be prevented without provision of an exhaust fan or a cooling fan. In addition, because provision of the exhaust fan or the cooling fan is not needed, size and production costs of the image forming apparatus 1 and noise can be reduced. Further, the fixing device 50 need not be provided at the upper part of the image forming apparatus 1. As a result, a height of the image forming apparatus 1 can be reduced, thereby making the image forming apparatus 1 more compact. The foregoing illustrative embodiments are applicable to a tandem type compact image forming apparatus such as the image forming apparatus 1 in which the four image forming units 4 and the fixing device 50 are arranged side by side in the horizontal direction to convey the sheet from the image forming units 4 to the fixing device 50 along a straight path.

It is to be noted that, the foregoing illustrative embodiments are applicable not only to the above-described image forming apparatus 1 illustrated in FIG. 1, but also to an image forming apparatus, such as a copier, a printer, a facsimile machine, and a multifunction device having two or more of copying, printing, and facsimile functions. Although the air drawn from the intake opening 92 is guided to the image forming unit 4K and the optical unit 9 in the foregoing illustrative embodiments, alternatively, the flow path for the air within the image forming apparatus 1 may be changed to guide the air to the other components provided near the fixing device 50.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

an intake opening;

at least one image developing or optical device or component positioned in the image forming apparatus;

a fixing device that heats a recording medium and is removably installable into a first position in the image forming apparatus above the intake opening and horizontally adjacent to the at least one image developing or optical device or component;

a partition, located in a second position between the fixing device and the at least one image developing or optical device or component in a horizontal direction, and including a first side that faces the fixing device and a second side that faces the at least one image developing or optical device or component;

an entrance guide attached to the fixing device and angled upward from an upstream end including a plurality of ribs to a downstream end along a conveyance direction of the recording medium; and a flow path that extends through a gap between the fixing device and the at least one image developing or optical device or component in both a vertical direction crossing the conveyance direction at the entrance guide, and the horizontal direction from the first side to the second side of the partition, wherein an outside air is drawn from the intake opening at least by a negative pressure generated by an upward current of hot air generated from the fixing device, wherein the recording medium is guided by the entrance guide in the conveyance direction over the entrance guide and into the fixing device, wherein the flow path directs the outside air vertically upward through the plurality of ribs in an area on the first side of the partition, horizontally from an area downstream of the plurality of ribs in the flow path on the first side of the partition to an area on the second side of the partition, and to the at least one image developing or optical device or component, and wherein the partition guides the outside air onto the at least one image developing or optical device or component separately from the hot air generated from the fixing device, extends substantially vertically in the second position and divides the gap, includes a lower end at a position where the outside air drawn from the intake opening is mixed with the hot air generated by the fixing device, and is substantially parallel to an exterior part of the fixing device.

2. The image forming apparatus according to claim 1, wherein the entrance guide further comprises a planar portion without ribs, provided downstream from the plurality of ribs in the conveyance direction of the recording medium.

3. The image forming apparatus according to claim 1, wherein the entrance guide comprises holes, wherein the outside air passes through each of the holes in the area on the first side of the partition.

4. The image forming apparatus according to claim 3, wherein the holes are provided at portions other than portions where front corners of the recording medium pass.

5. The image forming apparatus according to claim 3, wherein a part of each of the holes contacts a leading edge of the recording medium contacts, wherein the part of each of the holes is curved.

6. The image forming apparatus according to claim 1, wherein an attachment of the entrance guide to the fixing device includes a fulcrum, wherein the entrance guide moves about the fulcrum between a guide position to guide the recording medium into the fixing device and a path formation position to form the flow path for the air drawn from the intake opening.

7. The image forming apparatus according to claim 1, further comprising a fluorinated resin coating a surface of the entrance guide.

8. The image forming apparatus according to claim 1, wherein the entrance guide is integrally formed with the exterior part of the fixing device.

9. The image forming apparatus according to claim 1, wherein the entrance guide is a separate member attached to the exterior part of the fixing device.

10. The image forming apparatus according to claim 1, wherein at least a part of the partition is formed of a heat-resistant member.

11. The image forming apparatus according to claim 1, wherein the gap between the fixing device and the at least one image developing or optical device or component is greater than or equal to 10 mm.

12. The image forming apparatus according to claim 1, wherein heating of the fixing device is automatically stopped to change the fixing device to a standby mode each time a predetermined period of time elapses or images are formed on a predetermined number of recording media during continuous image formation.

13. The image forming apparatus according to claim 1, wherein the fixing device comprises:

a fixing member having a heat source therein; and an opposing member provided opposite the fixing member to form a fixing nip between the fixing member and the opposing member.

14. The image forming apparatus according to claim 13, wherein the fixing member is controlled to have a surface temperature of 165° C. or lower.

15. The image forming apparatus according to claim 1, wherein the fixing device includes an opening, wherein the recording medium is conveyed into the opening and inside the fixing device, wherein the entrance guide covers and uncovers the opening, and wherein the opening is automatically covered by the entrance guide upon removal of the fixing device from the image forming apparatus.

16. An image forming apparatus comprising:

an intake opening;

at least one image developing or optical device or component positioned in the image forming apparatus;

a fixing device including a recording medium opening and being removably installable in the image forming apparatus to heat a recording medium moving in a conveyance direction through the recording medium opening into an interior of the fixing device to fix an image onto the recording medium;

an entrance guide attached to the fixing device and including a recording medium guide face and an end with a plurality of ribs; and a flow path that extends through a gap in both a vertical direction crossing the conveyance direction at the entrance guide, and a horizontal direction from a first side of the gap adjacent to the fixing device to a second side of the gap adjacent to the at least one image developing or optical device or component, wherein an outside air is drawn from the inlet opening at least by a negative pressure generated by an upward current of hot air generated from the fixing device, wherein the entrance guide moves between a guide position to guide the recording medium in the conveyance direction over the entrance guide into the fixing device and a path formation position retracted from the guide position to form the flow path for the outside air, opens the recording medium opening in the guide position and closes the recording medium opening in the path formation position, moves to the path formation position to automatically close the recording medium opening as the fixing device is removed from the image forming apparatus, and exposes the recording medium guide face to an exterior of the fixing device so that the recording medium guide face is oriented in the vertical direction and faces away from the interior of the fixing device when the entrance guide moves from the guide position to the path formation position, and wherein the flow path directs the outside air vertically upward across the plurality of ribs in an area on the first side of the gap, horizontally from an area downstream of the plurality of ribs in the flow path on the first side of the gap to an area on the second side of the gap, and to the at least one image developing or optical device or component.

17. The image forming apparatus according to claim 16, wherein the entrance guide includes a surface coated with a fluorinated resin and integrally formed with the exterior part of the fixing device.

* * * * *